US006995754B2

(12) United States Patent
Suetsugu et al.

(10) Patent No.: US 6,995,754 B2
(45) Date of Patent: Feb. 7, 2006

(54) PLASMA DISPLAY MODULE

(75) Inventors: Hiroshi Suetsugu, Tokyo (JP); Taku Ohzono, Tokyo (JP)

(73) Assignee: Pioneer Corporation, Tokyo (JP)

( * ) Notice: Subject to any disclaimer, the term of this patent is extended or adjusted under 35 U.S.C. 154(b) by 453 days.

(21) Appl. No.: 10/008,856

(22) Filed: Nov. 8, 2001

(65) Prior Publication Data

US 2002/0053998 A1 May 9, 2002

(30) Foreign Application Priority Data

Nov. 8, 2000 (JP) ..... 2000-340437

(51) Int. Cl.
*G09G 3/28* (2006.01)

(52) U.S. Cl. ..... 345/204; 345/37; 345/60; 345/80; 345/94; 345/95; 345/98; 345/208; 345/210; 345/211; 315/169.4

(58) Field of Classification Search ..... 345/60, 345/63, 68, 41, 89, 95, 211, 37, 80, 94, 98, 345/204, 208, 210; 315/387, 169.4; 307/80, 307/81, 85, 86, 87
See application file for complete search history.

(56) References Cited

U.S. PATENT DOCUMENTS 4,027,195 A * 5/1977 Shutoh et al. ..... 347/145
5,107,176 A * 4/1992 Endo et al. ..... 313/583
5,337,070 A * 8/1994 Kitajima et al. ..... 345/211
5,493,685 A * 2/1996 Zenda ..... 713/340
5,576,735 A * 11/1996 Kikuchi et al. ..... 345/173
5,686,933 A * 11/1997 Okada et al. ..... 345/95
6,002,385 A * 12/1999 Silverbrook ..... 345/100
6,040,827 A * 3/2000 Shiina et al. ..... 345/208
6,124,840 A * 9/2000 Kwon ..... 345/100
6,317,122 B1 * 11/2001 Yamazaki ..... 345/211
6,448,947 B1 * 9/2002 Nagai ..... 345/60
6,674,417 B2 * 1/2004 Hsu et al. ..... 345/60

OTHER PUBLICATIONS

Yamamoto et al.; Waveform generator with a read only memory and a matrix display using the same; Pub. Date Mar. 6, 1998; WP 0 845 768 A2.*

* cited by examiner

*Primary Examiner*—Ricardo Osorio
*Assistant Examiner*—Vincent E. Kovalick
(74) *Attorney, Agent, or Firm*—Drinker Biddle & Reath LLP

(57) ABSTRACT

A plasma display panel, driving circuits for driving the plasma display panel, and a power circuit into which an external alternating current is inputted are provided to a plasma display module. The power circuit supplies driving voltages to the driving circuits. The power circuit outputs an external source voltage to be used by an external power circuit and a control voltage for controlling operations of an interface board to which source voltages of the interface board are supplied from the external power circuit. Furthermore, operations of the power circuit are controlled with control signals output by the interface board.

16 Claims, 2 Drawing Sheets

PLASMA DISPLAY MODULE

BACKGROUND OF THE INVENTION

1. Field of the Invention

The present invention relates to a plasma display module to be integrated into a plasma display and, more particularly, to a plasma display module wherein a power circuit can be easily designed.

2. Description of the Related Art

FIG. 1 is a block diagram showing a prior plasma display. A power circuit 8 is provided for the prior plasma display. The power circuit 8 includes a power circuit for driving a plasma display module and a power circuit for driving an interface board. The interface board is used, for example, to perform the analog/digital conversion of an analog image input signal to a digital image signal.

A source voltage necessary to drive the interface board is designed by a plasma display manufacturer and depends on an integrated circuit (IC) which has been customized for each manufacturer. Accordingly, the source voltage varies from one manufacturer to another and has not been standardized. For example, the source voltage can be 3.3V, 5V, 7V, or 12V.

Accordingly, where the plasma display manufacturer develops a power source, it is necessary to develop a new integrated power circuit to drive both the interface board and plasma display module.

On the other hand, to drive the plasma display module a high-voltage and high-capacity power source is necessary. Therefore, in order to develop such an integrated power circuit great expense and more man-hours are required.

SUMMARY OF THE INVENTION

It is an object of the present invention to provide a plasma display module for which the development costs and man-hours for development of a power circuit by a plasma display manufacturer can be reduced.

A plasma display module according to the present invention comprises: a plasma display panel; driving circuits which drive the plasma display panel; and a power circuit into which an external alternating current is inputted. The power circuit supplies driving voltages to the driving circuits. The power circuit outputs an external source voltage to be used by an external power circuit and a control voltage for controlling operations of an interface board to which source voltages of the interface board are supplied from the external circuit. Operations of the power circuit are controlled with control signals output by the interface board.

In the present invention, the power circuit for supplying a source voltage to the driving circuit is provided in the plasma display module, accordingly the power circuit is supplied by a plasma display module manufacturer. Therefore, when a plasma display manufacture develops a plasma display, this can be carried out by only designing an interface board which A/D converts an analog image input signal and outputs a digital image signal and an external power circuit for driving the interface board. Accordingly, the development costs and man-hours for development of the power circuit can be reduced.

In addition, since the power circuit is delivered after being integrated into a plasma display module, the plasma display manufacturer can omit adjustment of the driving voltages. Also therein, man-hours can be reduced.

DETAILED DESCRIPTION OF THE PREFERRED EMBODIMENTS

Figure 1:
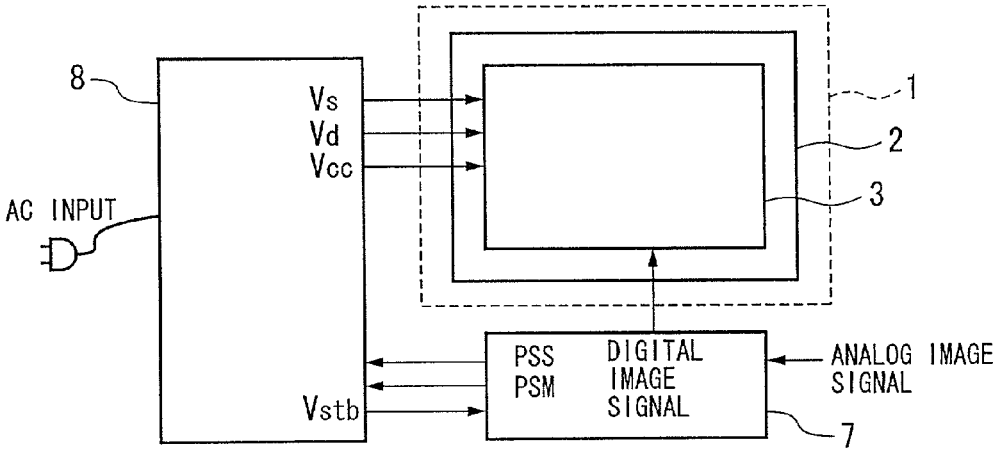
FIG. 1 PRIOR ART
FIG. 1 is a block diagram showing a prior plasma display panel.
Figure 2:
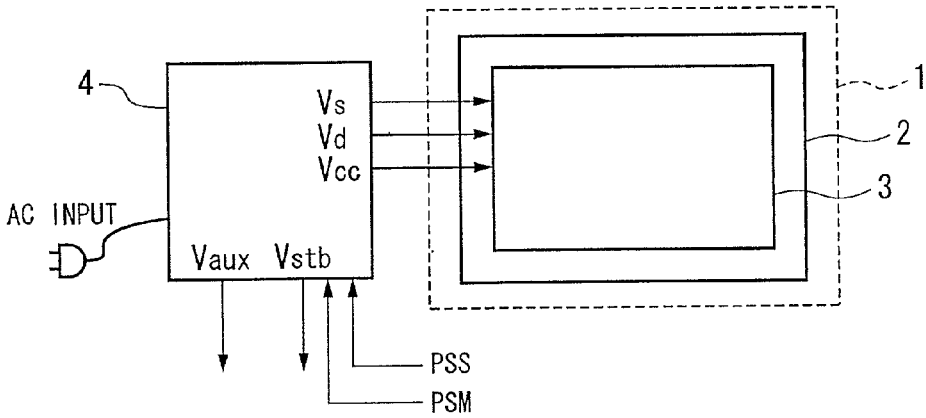
FIG. 2 is a block diagram showing a construction of a plasma display module with a power source according to an embodiment of the present invention.

Hereinafter, a preferred embodiment of the present invention will be described in detail with reference to the attached drawings. FIG. 2 is a block diagram showing a construction of a plasma display module with a power source according to an embodiment of the present invention.

A plasma display panel 2 and a driving circuit 3 for driving the plasma display panel 2 are provided for a plasma display module 1.

A power circuit 4 which generates source voltages for driving the plasma display module 1 receives inputs of an AC power source, a control signal PSS, and a control signal PSM. The power circuit 4 outputs a control voltage Vstb, a power voltage Vaux, and a driving voltage group to be supplied to the driving circuit 3. The driving voltage group consists of a power voltage Vcc of, for example, 5V, a source voltage for data electrodes Vd of, for example, 60V, and a source voltage for sustaining electrodes of, for example, 160V, however, other voltages may be included in the driving voltage group.

Figure 3:
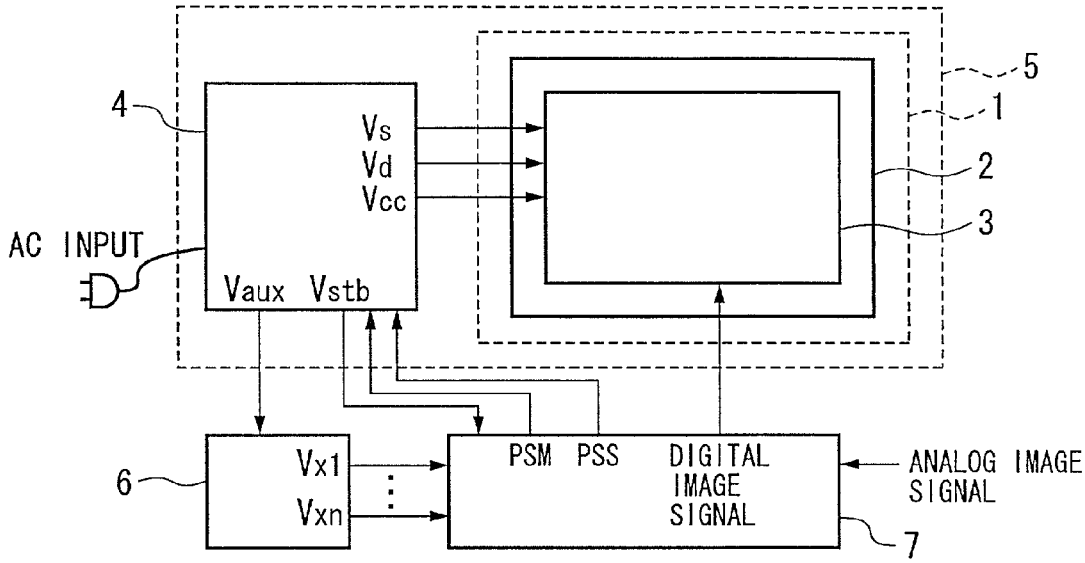
FIG. 3 is a block diagram showing a plasma display using the plasma display module with a power source shown in FIG. 2.

FIG. 3 is a block diagram showing a plasma display using the plasma display module with a power source shown in FIG. 2. In a case where the plasma display module 5 with a power source shown in FIG. 2 is incorporated into a plasma display, for example, an interface board 7 which A/D converts an analogue image input signal and outputs a digital image signal, and a power circuit 6 which generates source voltages for driving the interface board 7 are provided. The source voltage Vaux is supplied to the power circuit 6 and the control voltage Vstb is supplied to the interface board 7. On the other hand, the control signals PSS and PSM are output from the interface board 7 to the power circuit 4. N types of source voltages Vx1 through Vxn are supplied from the power circuit 6 to the interface board 7. Voltages of, for example, 3.3V, 5V, and 7V are included in the source voltages Vx1 thorough Vxn. In addition, an analogue image signal is inputted into the interface board 7. A digital image signal which is obtained through conversion by an A/D converter that is built in the interface board 7 is inputted into the driving circuit 3.

Figure 4:
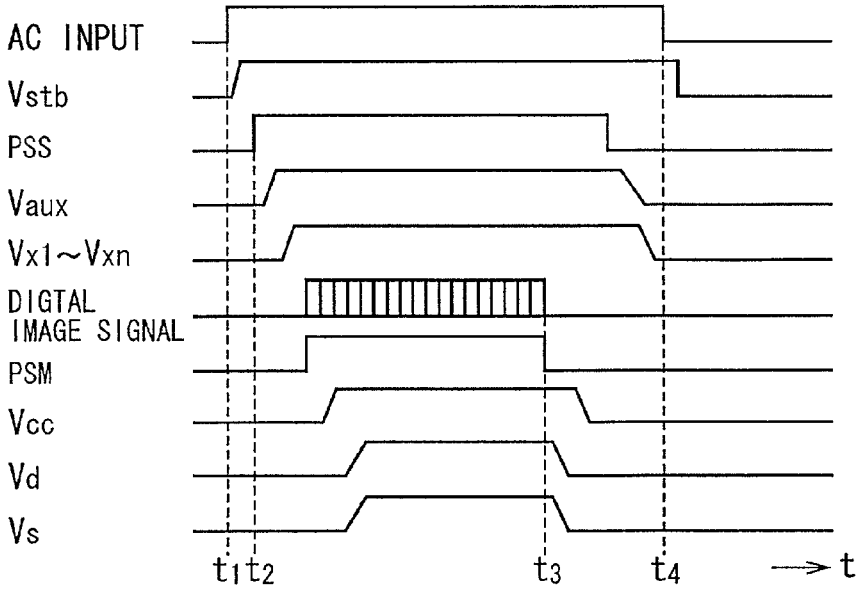
FIG. 4 is a timing chart showing operations of the plasma display shown in FIG. 3.

Thereafter, operations of the plasma display constructed as mentioned above will be described. FIG. 4 is a timing chart showing operations of the plasma display shown in FIG. 3.

First, a description will be given of operations when starting up the power source.

When the AC power source is inputted at time t1, the control voltage Vstb becomes high level and the plasma display reaches a stand-by state.

When a power source of the plasma display is turned on at time t2, a control portion of the interface board 7 starts to operate and the control signal PSS becomes high level.

The power circuit 4 makes, when the high-level control signal PSS is inputted thereto, the source voltage Vaux high level. In addition, the power circuit 6 makes, when the high-level source voltage Vaux is inputted thereto, the source voltages Vx1 through Vxn high level. As a result, the interface board 7 starts A/D conversion.

The interface board 7 begins to supply the digital image signal to the driving circuit 3 and simultaneously makes the control signal PSM high level.

The power circuit 4 makes, when the high-level control signal PSM is inputted thereto, the low source voltage Vcc high level and then makes the high power voltages Vd and Vs high level in turn. As a result, the plasma display panel 2 can display an image. If a high power voltage is started up earlier than a low power voltage, a high voltage circuit may have floating gate levels and a penetration current may flow, causing damage to the high voltage circuit. For the prevention of the damage, in the present embodiment, the high power voltages Vd and Vs are made high level after the low power voltage Vcc is made high level.

Thereafter, a description will be given of operations when shutting down the power source.

When a power source of the plasma display is turned off at time t3, the interface board 7 stops outputting the digital image signal and simultaneously makes the control signal PSM low level.

When the control signal PSM becomes low level, the power circuit 4 makes the source voltages Vd and Vs low level and then makes the source voltage Vcc low level.

Thereafter, after an elapse of a predetermined time of, for example, 200 m seconds, the interface board 7 makes the control signal PSS low level.

When the control signal PSS becomes low level, the power circuit 4 makes the source voltage Vaux low level. When the source voltage Vaux becomes low level, the power circuit 6 makes the source voltages Vx1 through Vxn low level. As a result, the plasma display reaches a stand-by state.

Thereafter, when the AC power source is disconnected at time t4, the power circuit 4 makes the control voltage Vstb low level and the stand-by state is cancelled.

What is claimed is:

1. A plasma display, said display comprising:

a plasma display module;

an interface board controlled by a control voltage and supplied with a source voltage so as to produce an image signal and an inside voltage source control signal; and an external power circuit which supplies said source voltage to said interface board in accordance with an auxiliary voltage, wherein said plasma display module includes:

a plasma display panel;

a driving circuit for driving said plasma display panel in response to driving voltages supplied thereto thereby causing said plasma display to perform its display operation on the basis of said image signal; and an inside power circuit driven by an external alternating current, for producing said control voltage for controlling operations of said interface board and said auxiliary source voltage, said inside power circuit being controlled to supply said driving voltages to said driving circuit in accordance with said inside voltage source control signal supplied from said interface board.

2. A plasma display according to claim 1, wherein said inside voltage source control signal contains first and second source control signals, and said inside power circuit supplies said control voltage to said interface board when said external alternating current is inputted to said inside power circuit, and supplies said auxiliary voltage to said external power circuit in response to said first source control signal, and supplies said driving voltages to said driving circuit in response to said second source control signal.

3. A plasma display according to claim 1, wherein said driving voltages have different values from each other, said inside power circuit starts up a lowest-value voltage of said driving voltages at a timing earlier than that of a highest-value voltage of said driving voltages, in response to said inside voltage source control signal.

4. A plasma display according to claim 3, wherein said inside power circuit shuts down said highest-value voltage at a timing earlier than that of said lowest-value voltage, in response to said inside voltage source control signal.

5. A plasma display according to claim 1, wherein said inside power circuit initiates its production of said control voltage earlier than said auxiliary voltage.

6. A plasma display module according to claim 5, in which said inside power circuit starts up a lowest-value voltage of said driving voltages at a timing earlier than that of a highest-value voltage of said driving voltages, in response to said inside voltage source control signal.

7. A plasma display module comprises:

a plasma display panel;

driving circuits which drive said plasma display panel; and a power circuit into which an external alternating current is inputted from outward, said power circuit supplying driving voltages to said driving circuits, and outputting an external source voltage to be used by an external power circuit and a control voltage for controlling operations of an interface board to which source voltages of said interface board are supplied from said external power circuit, and operations of said power circuit being controlled with control signals output by said interface board, wherein said control signals output by said interface board contain first and second control signals, and said power circuit outputs said control voltage to said interface board when said external alternating current is inputted to said power circuit, outputs said external power voltage to said external power circuit when said first control signal is inputted to said power circuit, and outputs said driving voltages to said driving circuits when said second control signal is inputted to said power circuit.

8. A plasma display module according to claim 7, wherein said driving voltages contain a plurality of voltages having different values, and said power circuit starts up a lowest-value voltage of said plurality of voltages earlier than a highest-value voltage of said plurality of voltages.

9. A plasma display module according to claim 7, wherein said driving voltages contain a plurality of voltages having different values, and said power circuit shuts down a highest-value voltage of said plurality of voltages earlier than a lowest-value voltage of said plurality of voltages.

10. A plasma display module according to claim 7, wherein said driving voltages contain a plurality of voltages having different values, and said power circuit starts up a lowest-value voltage of said plurality of voltages earlier than a highest-value voltage of said plurality of voltages and shuts down said highest-value voltage earlier than said lowest-value voltage.

11. A plasma display module according to claim 7, wherein said driving voltages contain a plurality of voltages having different values, and said power circuit starts up a lowest-value voltage of said plurality of voltages earlier than a highest-value voltage of said plurality of voltages.

12. A plasma display module according to claim 7, wherein said driving voltages contain a plurality of voltages having different values, and said power circuit shuts down a highest-value voltage of said plurality of voltages earlier than a lowest-value voltage of said plurality of voltages.

13. A plasma display module according to claim 7, wherein said driving voltages contain a plurality of voltages having different values, and said power circuit starts up a lowest-value voltage of said plurality of voltages earlier than a highest-value voltage of said plurality of voltages and shuts down said highest-value voltage earlier than said lowest-value voltage.

14. A plasma display module, comprising:

a plasma display panel;

a driving circuit for driving said plasma display panel in response to driving voltages supplied thereto thereby causing said plasma display to perform its display operation on the basis of an image signal applied thereto; and an inside power circuit driven by an external alternating current, and producing a control voltage for controlling operations of an interface board which is operative under a source voltage supplied thereto from an external power circuit and an auxiliary voltage for causing said external power circuit to be active, said inside power circuit being controlled for supplying said driving voltages to said driving circuit, in accordance with a voltage source control signal supplied from said interface board.

15. A plasma display module according to claim 14, wherein said inside voltage source circuit initiates its production of said control voltage earlier than said auxiliary voltage.

16. A plasma display module according to claim 14, wherein said inside power circuit shuts down said highest-value voltage at a timing earlier than that of said lowest-value voltage, in response to said voltage source control signal.

* * * * *